United States Patent [19]

Cederholm et al.

[11] Patent Number: 5,009,749

[45] Date of Patent: Apr. 23, 1991

[54] WEB DECURLER

[75] Inventors: Roger Cederholm, Roscoe, Ill.; Christopher J. Plude, Beloit, Wis.

[73] Assignee: Martin Automatic, Inc., Rockford, Ill.

[21] Appl. No.: 564,855

[22] Filed: Aug. 9, 1990

[51] Int. Cl.[5] ..... B65H 23/34

[52] U.S. Cl. ..... 162/271; 162/270; 162/197; 493/459

[58] Field of Search ..... 162/197, 270, 271; 493/459

[56] References Cited

U.S. PATENT DOCUMENTS 3,661,703 5/1972 Shelor ..... 162/271

4,360,356 11/1982 Hall ..... 162/271

*Primary Examiner*—Richard V. Fisher

*Assistant Examiner*—Brenda Lamb

*Attorney, Agent, or Firm*—McAndrews, Held & Malloy

[57] ABSTRACT

A web decurler for selectively removing the different degrees of curl from a running web. The decurler includes first, second and third relatively large diameter, rotatable rollers and a fourth roller assembly having at least one relatively small diameter, rotatable roller. All of the rollers are disposed adjacent to the web path so that the running web may wrap about a portion of their outer peripheral surfaces. The positions of the first and second rollers remain fixed with respect to the decurler, while the third roller is spaced a fixed predetermined distance and may be moved about the central longitudinal axis of one of the first and second rollers. The fourth roller assembly is spaced from and is movable about a preselected axis that is spaced from the other rollers. A first member supports the fourth roller assembly for movement about the preselected axis. A cam profile, carried by the first member, cooperates with a cam follower, associated with the third roller, so that the position of the third roller is determined by the position of the fourth roller assembly and so that the length of the web path in the decurler remains constant regardless of the relative positions of the rollers.

18 Claims, 4 Drawing Sheets

WEB DECURLER

BACKGROUND OF THE INVENTION

The present invention relates to web decurlers for removing curl from a running web, and more particularly, to a web decurler for removing curl from a running web without changing the web register between web processing operations located on the upstream and downstream sides of the decurler.

Generally webs are stored in tightly wound rolls before they are processed. Sometimes they are re-rolled in between web processing operations. Such storage imparts a curl to the web, and particularly webs made from stiffer materials such as, for example, paper board used to make milk cartons.

It has been recognized by those working in this art that webs should be decurled, especially when the last web processing operation includes cutting the web into sheets or the like. If a web has not been decurled, or properly decurled, difficulty may be experienced in stacking the cut, free sheets. For example, if the remaining curl imparts a clockwise, or downwardly facing curve, to the sheets as they are cut, the leading edge of a sheet has a tendency to "catch" on the trailing edge of the preceding sheet as they are stacked. If the sheets have a counter-clockwise, or upwardly facing curve, the sheets have a tendency to "fly" when being stacked even to the extent of flying off the stacking table.

Prior web decurlers have attempted to remove the curl from running webs by passing the running web, in series, about the peripheral surfaces of a first relatively larger diameter roller, a second relatively smaller diameter roller and then a third relatively larger diameter roller. The three rollers are disposed in a generally triangular arrangement, with the central longitudinal axis of the relatively smaller diameter roller being offset to one side or the other, from a plane which includes the central longitudinal axes of the relatively larger diameter rollers.

In some of the prior decurlers, the relatively smaller diameter roller could be moved with respect to the plane of the relatively larger diameter rollers. Such movement of the relatively small diameter roller changed the amount that the running web was wrapped about the outer peripheral surfaces of the three rollers and thus the degree of curl that could be removed from the running web. The relatively smaller diameter roller could also be positioned on one side or the other of the plane including the central longitudinal axes of the relatively larger diameter rollers so as to remove selectively either clockwise or counter-clockwise curl from the running web.

Such movement of the relatively smaller diameter roller in these prior decurlers, however, changed the length of the web path through the decurler. This change in the web path caused problems in maintaining web registration between web processing operations located upstream and downstream of the decurler. Electrical compensating systems have been proposed and used to attempt to maintain web registration in such decurlers. Their usage has not been particularly successful and has increased the costs to the decurling operation.

SUMMARY OF THE INVENTION

The improved web decurler of the present invention may be utilized to remove selectively different degrees of curl from a running web while maintaining web registration. The running web passes through the web decurler along a web path that is adjacent to three relatively larger diameter, rotatable rollers and one smaller diameter, rotatable roller such that it will wrap about portions of the outer peripheral surfaces of these four rollers.

The relative positions of the four rollers may be selectively adjusted or moved, with respect to each other, so that different degrees of curl may be selectively removed from the running web. This relative movement of the rollers is controlled such that the total length of the web path of the running web in the improved decurler remains constant, regardless of the relative positions of the four rollers. This constancy in the web path length, assures that web registration will exist between a web processing operation located downstream of the improved decurler and the web upstream of the improved decurler.

Accordingly, it is a principal object of the present invention to provide an improved web decurler for selectively removing different degrees of curl from a running web, while maintaining web registration, as the running web passes along a web path defined in and through the web decurler so that the running web, although processed as a web, will lie flat, when cut and delivered as free sheets, downstream of the web decurler.

Another object of the present invention is to provide an improved web decurler of the type described wherein the decurler includes first, second and third relatively larger diameter, rotatable rollers that are disposed adjacent to the web path in the web decurler so that the running web may wrap about a portion of their peripheral surfaces as the web passes through the decurler; and wherein the decurler also includes a fourth roller assembly having at least a fourth, relatively smaller diameter, rotatable roller that is also disposed adjacent to the web path so that the running web may pass about a portion of its peripheral surface as the web passes through the web decurler. A related object of the present invention is to provide an improved web decurler of the type described wherein the third roller is disposed between the first and second rollers along the web path and is spaced a fixed predetermined distance from and movable about one of the first and second rollers; and wherein the fourth roller is disposed between the third roller and the other of the first and second rollers along the web path and is spaced from and movable about a preselected axis which, in turn, is spaced from the longitudinal axes of a first, second and third rollers.

Still another object of the present invention is to provide an improved web decurler of the type described wherein the positions of the first and second rollers are fixed with respect to each other and with respect to the decurler; and wherein the position of the third roller and the fourth roller may be moved selectively, relatively with respect to each other and with respect to the first and second rollers so as to control the wrap of the running web about the outer peripheral surfaces of the four rollers and to thereby control the degree of curl removed from the running web and so that the length of the web path of the running web in the web decurler remains constant regardless of the relative positions of the third roller and the fourth roller.

A further object of the present invention is to provide an improved web decurler of the type described wherein the third roller is mounted on a first arm member and is movable, along a first arc, about the longitudinal center axis of the one roller; wherein the fourth roller is mounted on a second arm member and is movable, along a second arc, about the preselected spaced axis; wherein one of the first and second arm members includes a cam surface and the other of the first and second arm members includes a cam follower, with the cam follower being adapted to follow the cam surface so that movement of the one member causes the other member to move in accordance with the cam profile of the cam surface and so that movement of the one arm member and its associated roller, to a preselected position along its arc, results in the other arm member, and its associated roller, being moved to a preselected position along its arc.

A still further object of the present invention is to provide an improved web decurler of the type described wherein a first plane is defined to include the longitudinal central axes of the third roller and the other roller; and wherein the preselected spaced axis is located, with respect to the first plane, such that the fourth roller assembly may be located on one side of the first plane when it is desired to decurl a clockwise curl from the running web and on the other side of the first plane when it is desired to decurl a counter-clockwise curl. A related object of the present invention is to provide an improved web decurler of the type described wherein the fourth roller assembly includes a pair of fourth, rotatable rollers; wherein one of the pair of the fourth rollers is adapted to have the running web wrap about its peripheral surface when the fourth roller assembly is located on one side of the first plane; and wherein the other of the pair of fourth rollers is adapted to have the running web wrap about its outer peripheral surface when the fourth roller assembly is located on the other side of the first plane.

These and still other objects and advantages of the present invention are more fully set forth in the detailed description of the preferred embodiment of the present invention which follows.

DESCRIPTION OF THE PREFERRED EMBODIMENT

Figure 1:
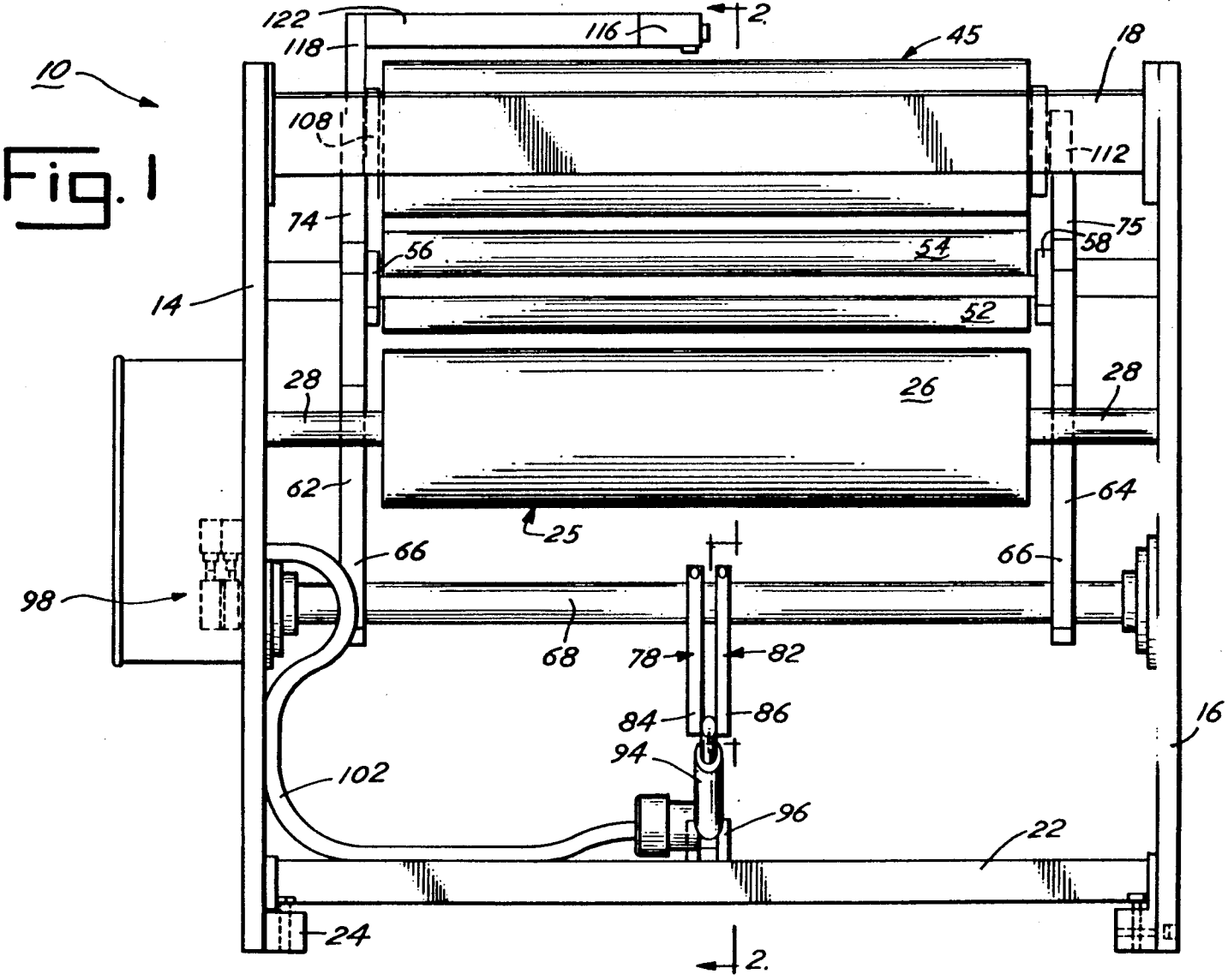
FIG. 1 is a front elevational view of the preferred embodiment of the improved decurler.
Figure 2:
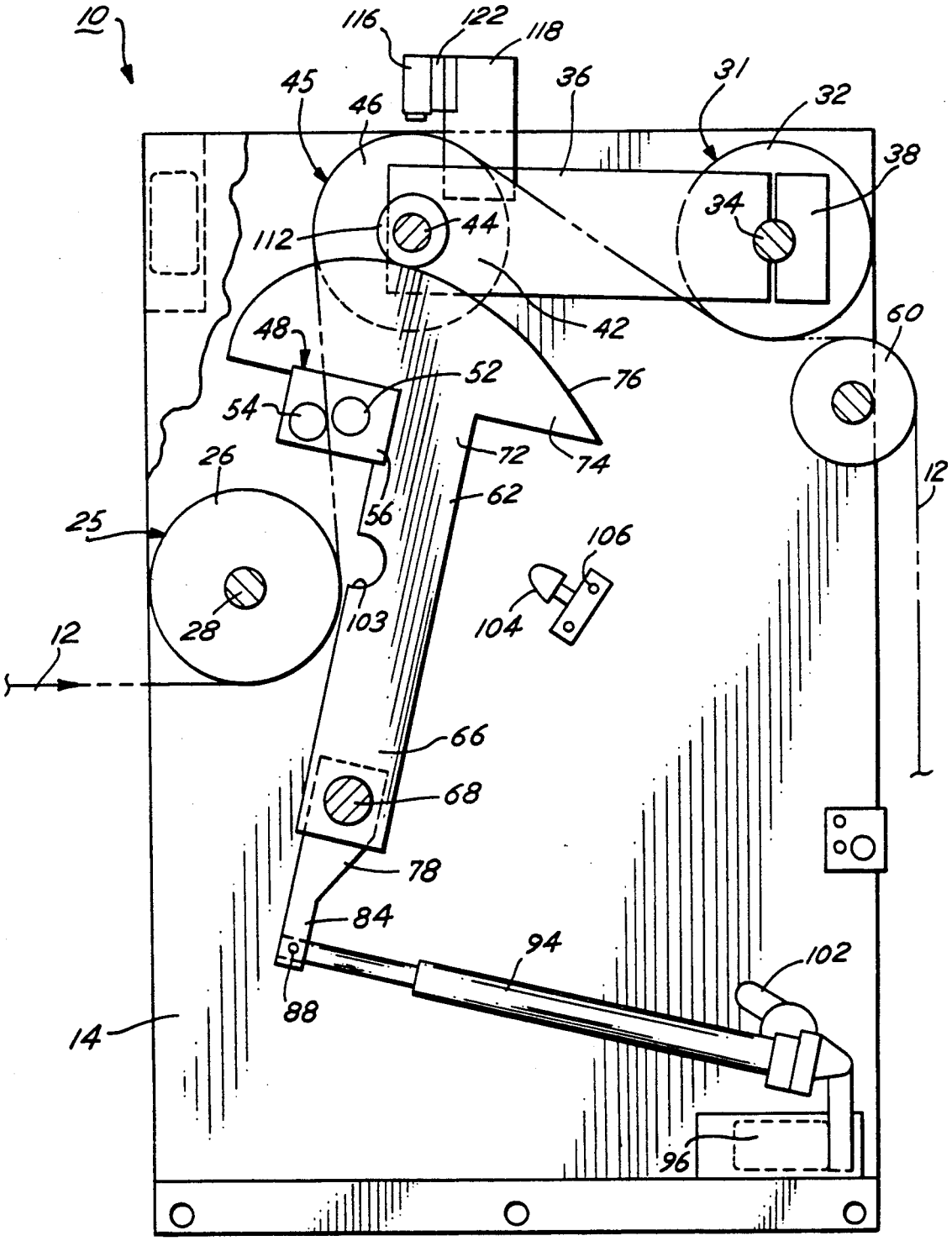
FIG. 2 is a vertical cross-sectional view taken generally along the line 2—2 of FIG. 1.

Referring noW to FIGS. 1 and 2, the preferred embodiment of the web decurler of the present invention is shown generally at 10. As noted above, the decurler is adapted to remove either clockwise or counter-clockwise curl from a running web 12. In most instances, the running web will have been processed, by a web processing operation, not shown (such as, for example, a web printer) upstream of the decurler and will proceed, after leaving the decurler, to another web processing operation, not shown (such as, for example, a web sheet cutter) downstream from the decurler.

The decurler 10 includes a pair of parallel side plates 14 and 16 that are spaced from each other and that extend vertically upwardly from the floor or other surface upon which the decurler 10 rests. The upper and lower ends of the plates 14 and 16 are interconnected by a plurality of transverse spacer tubes, two of which are indicated at 18 and 22. Mounting feet 24 are connected along the lower edges of the plates 14 and 16 and are used to secure the plates to the floor.

As best illustrated in FIG. 2, a first roller assembly 25, including a first roller 26, is mounted on and between the plates 14 and 16 about midway between the upper and lower ends of the plates and adjacent to the upstream end of the decurler. The roller 26 includes a central shaft 28 that is journaled in conventional bearing assemblies, not shown, mounted on the plates 14 and 16. The roller 26 has a relatively large diameter outer peripheral surface around which the running web 12 is adapted to be wrapped as it travels along its web path through the decurler. The position of the roller 26 is fixed with respect to the plates 14 and 16 although of course, the roller may rotate freely about its longitudinal central axis which is coaxial with the central longitudinal axis of the shaft 28.

A second assembly 31, including the second roller 32, is also mounted on and between the side plates 14 and 16, adjacent to the upper right hand corner, as shown in FIG. 2, of the decurler 10. The roller 32 has the same relatively large diameter as the roller 26. Its outer peripheral surface is located adjacent to the web path as the running web 12 passes through the decurler 10 such that the web may wrap about a portion of the outer peripheral surface as it proceeds along the web path. The roller 32 includes a central shaft 34 that is journaled and supported by conventional bearing assemblies, not shown, mounted on the side plates 14 and 16. Also and like the roller 26, the position of the roller 32 is fixed with respect to the plates 14 and 16, but it may rotate about its central longitudinal axis which is co-axial with the central longitudinal axis of the shaft 34.

A first pair of arm members 36 are attached, at their one ends 38 to the shaft 34; one between each side plate and the adjacent end of the roller 32. These arm members 36 project generally upstream, or to the left as shown in FIG. 2. The other ends 42 of the arm members support conventional bearing assemblies, not shown, that, in turn, journal the ends of a central shaft 44 of a third roller assembly 45, including the third roller 46. More specifically, the arm members 36 enable one to maintain a fixed predetermined distance between the third roller assembly 45 and the second roller assembly 31 and support the roller assembly 45 so that the roller 46 may rotate relative to the members 36. The roller 46 has the same relatively large diameter as the rollers 26 and 32 and includes an outer peripheral surface about which the running web 12 may wrap as the web proceeds along the web path through the decurler 10.

The ends 38 of the arm members 36 are attached to the shaft 34 so that the third roller assembly 45 may move or pivot with the shaft 34 and thus about the central longitudinal axes of the shaft 34 and the roller 32. In other words, the roller 46 may move along a first arc whose center is the longitudinal, coaxial axes of the shaft 34 and the roller 32.

A fourth roller assembly 48 is mounted between the side plates 14 and 16 and between the first and third rollers 26 and 46. This fourth roller assembly includes a pair of relatively smaller diameter rollers 52 and 54. A pair of spaced apart, parallel mounting plates 56 and 58 support conventional bearing assemblies, not shown, that in turn, journal the ends of the central shafts, not shown, of these rollers 52 and 54 so that the rollers may rotate about their central longitudinal axes. The rollers 52 and 54 are spaced apart so that the running web 12 may pass between them, as shown in FIG. 2, as it moves along the web path in the decurler 10.

An idler roller 60 is supported for rotation between the plates 14 and 16. It is positioned adjacent to the web path, downstream of the roller 32, and serves to direct the running web 12 out of and away from the decurler. This roller could be eliminated if it were desired to have the running web exit horizontally from the decurler. Additional idler rollers, not shown, may also be used to direct the running web from the decurler to downstream web processing operation(s), or for that matter, to the decurler from the upstream web processing operation(s).

As best shown in FIGS. 1 and 2, the lengths of the rollers 26, 32, 46, 52, 54, and 60, in directions parallel to their central longitudinal axes, are approximately the same. Similarly, their longitudinal central axes are substantially parallel.

The fourth roller assembly 48, including the mounting plates 56 and 58, are attached to and carried between a second pair of arm members 62 and 64. The lower ends 66 of these arm members 62 and 64, as shown in FIGS. 1 and 2, are secured to a transverse roll pin or shaft 68 which has its ends journaled in and supported by the side plates 14 and 16.

More specifically, the arm members 62 and 64 are attached to the roll pin 68, adjacent to the plates 14 and 16, respectively. These arm members rotate or move with the roll pin 68, about the central longitudinal axis of the roll pin. The mounting plates 56 and 58 are secured to the upper ends 72 of the arm members 62 and 64, respectively, so that the fourth roller assembly 48 is supported by and between the arm members 62 and 64. Similarly, a pair of cam members 74 and 75 are attached to the upper ends 72 of the arm members 62 and 64, respectively, above the mounting plates 56 and 58. These cam members include identical cam profile surfaces 76 which face upwardly, as shown in FIG. 2.

As noted above, the arm members 62 and 64 are mounted on the roll pin 68 so that they may rotate or move about the central longitudinal axis of that pin. When they do, their upper ends 72, and the rollers 52 and 54, move along a second arc that has, as its center, the longitudinal axis of the roll pin.

A pair of actuating arms 78 and 82 are secured to the roll pin 68. They are located adjacent to and spaced equi-distant from and on opposite sides of the midpoint of the roll pin 68. Specifically, these arms 78 and 82 are secured to the roll pin so that pivotal movement of the arms causes corresponding pivotal movement of the roll pin 68.

The distal end of a conventional, doubleacting, pneumatic linear actuator 94 extends between the lower depending ends 84 and 86 of the arms 78 and 82 and is connected with the ends 84 and 86 by a transverse pin 88. The other end of the linear actuator 94 is attached to brackets 96 which, in turn, are attached to a lower spacer tube 22.

A conventional pneumatic control system, shown generally at 98, is mounted on the side plate 14. This control system 98 is connected with the linear actuator 94 through conventional tubing, shown generally at 102, and may be manually operated by an operator of the decurler 10 so as to extend or retract the distal end of the linear actuator 94 a preselected distance. Such extension or retraction of the distal end of the linear actuator 94 results in the rotation of the roll pin 68, and thus in the pivotal movement of the arms 62 and 64 about the central longitudinal axes of the roll pin 68. By operating the control system 98, the position of the fourth roller assembly 48 and the cam profile surfaces 76 may be moved to preselected positions relative to the first, second and third rollers 26, 32, and 46 and also relative to the running web 12 as it moves along the web path in the decurler 10.

Each of the arm members 62 and 64 include a substantially semi-circular, cut away portion 103 approximately midway between their ends. The cut out portions 103 face toward the roller 26 and are aligned with the shaft 28 of that roller. They are designed to prevent interference between the shaft 28 and the members 62 and 64 during pivotal movement of the members towards the shaft 28.

As shown in FIG. 2, a pair of conventional bumpers 104 are attached to the inner, facing surfaces of the side plates 14 and 16 by mounting pads 106 and are aligned to contact the arm members 62 and 64. These bumpers 104 serve as "stops" to limit the extent that the arm members 62 and 64 may travel along the second arc, or in other words, about the central longitudinal axis of the roll pin 68, in a clockwise direction, as illustrated in FIG. 2.

A pair of cam followers 108 and 112 are supported on the opposite ends of the shaft 44 of the roller 46. Specifically a cam follower is between each of the ends of the roller 46 and its adjacent side plate 14 and 16. Each of these cam followers 108 and 112 is positioned so that its outer peripheral surfaces contacts and follows the cam profile surface 76 of the adjacent cam members 74 and 75.

The relationship between the cam followers 108 and 112 and the cam profile surfaces 76 are such that movement of the cam profile surfaces 76 results in movement of the roller 46 along its first arc about the central longitudinal axis of the shaft 34. More specifically, movement of the arm members 62 and 64, due to the actuator of the linear actuator 94, about the longitudinal axis of the roll pin 68 results in movement of the cam surfaces 76, and the rollers 52 and 54, to preselected positions along the second arc. Such movement of the cam surfaces 76, in turn, results in movement of the cam followers 108 and 112 corresponding to the cam profile of the cam surfaces 76. As the cam followers move, so does the roller 46. In other words, movement of the cam followers results in the roller 46 being moved to another position along the first arc and about the longitudinal central axis of the shaft 34 of the roller 32. The operator can thus selectively position the rollers 52 and 54, and correspondingly, the third roller 46, so that the decurler 10 will remove any desired degree of curl from the running web 12. As discussed below, the relative movement of the roller assembly 48 and the roller 46 does not, due to the arrangement of the four rollers and the profiles of the cam surfaces 76, change the length of the web path in the decurler.

Figure 3:
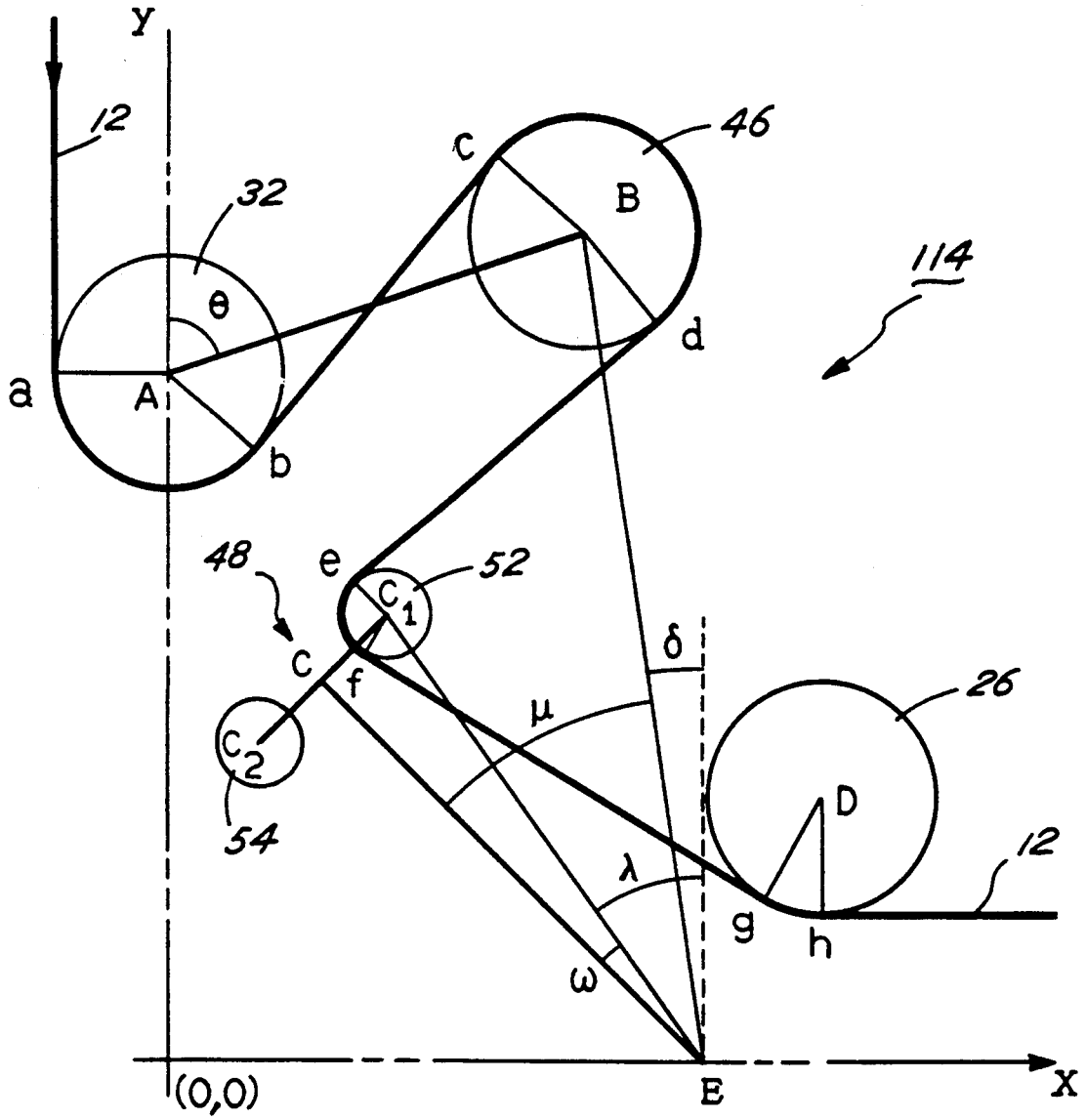
FIG. 3 is a schematic view of another arrangement of the roller assemblies in the improved decurler of the present invention, with the relatively smaller diameter roller assembly being shown in a position wherein the decurler may be used to remove a clockwise curl in the running web, with the rollers, and the angles and distances therebetween, being identified to facilitate the determination of the cam profile needed to achieve the advantages of the present invention.
Figure 4:
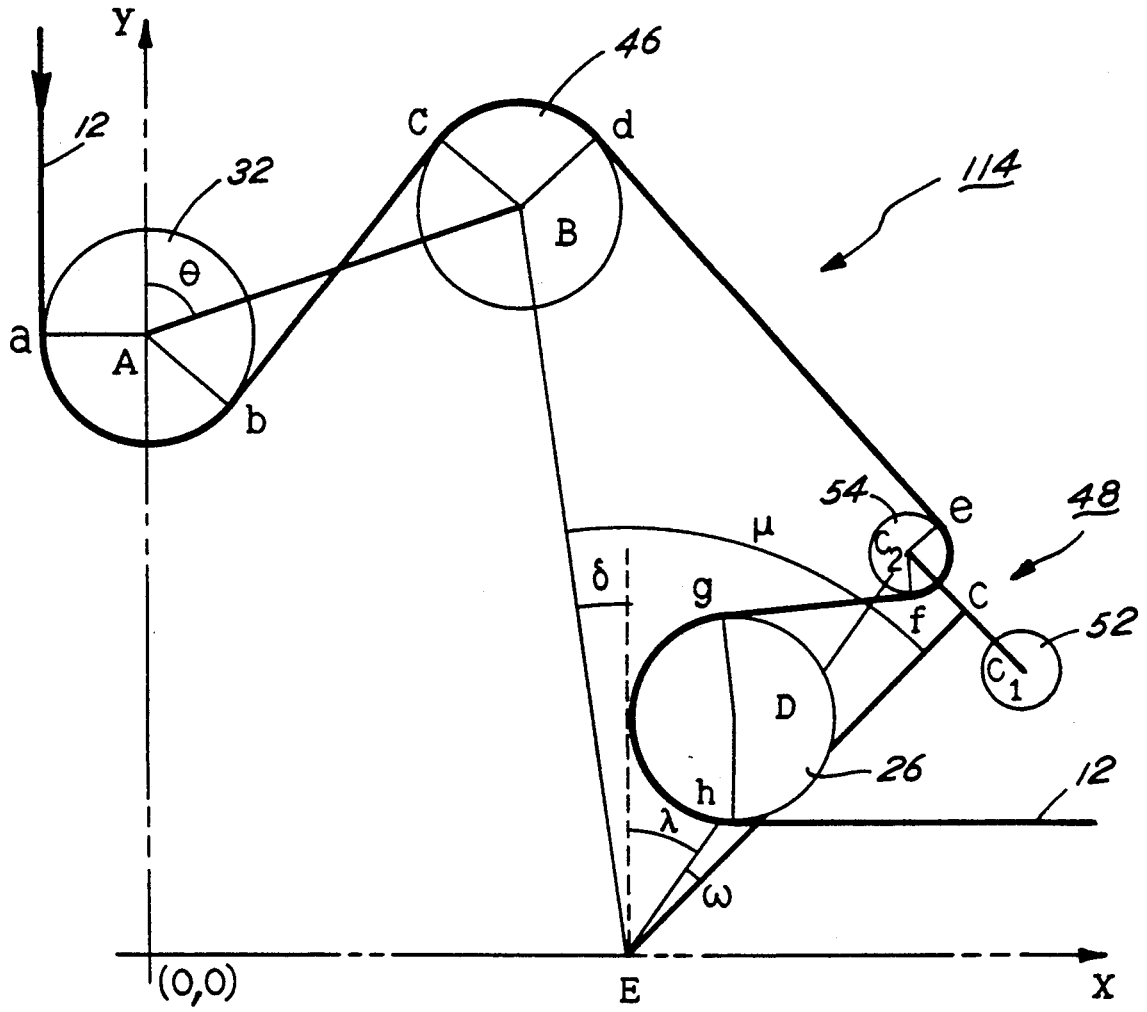
FIG. 4 is a schematic view, similar to FIG. 3, of the roller assemblies utilized in the improved decurler of the present invention, with the relatively smaller diameter roller assembly being positioned so as to enable the decurler to remove a counter-clockwise curl in the running web.

As best illustrated in FIGS. 3 and 4 and considering an imaginary plane containing the longitudinal axes of the roller 46 (the shaft 44) and the roll pin 68, the rollers 52 and 54 can be selectively positioned on one side or the other of that plane by operator actuation of the linear actuator 94. When the rollers 52 and 54 are positioned to the right of or clockwise from the position shown in FIG. 2, the running web 12 will wrap about the roller 54, as shown in FIG. 4, so as to remove a counter-clockwise curl from the running web. When these rollers 52 and 54 are positioned to the left of or counter-clockwise from the position shown in FIG. 2, the running web 12 will wrap about the roller 52, as shown in FIG. 3, so as to remove a clockwise curl from the running web. When the rollers 52 and 54 are positioned as shown in FIG. 2, that is, with the running web not being wrapped about either of the rollers 52 and 54, no significant curl will be removed from the running web.

By properly making the cam profile surfaces 76, the overall length of the running web 12 through the decurler 10 can be maintained constant regardless of the relative positions of the rollers 26, 32, 46, 52 and 54. FIGS. 3 and 4 illustrate a decurler 114, which is similar in structure and operation to the decurler 10, shown in FIGS. 1 and 2, except that the running web 12 (running from the left to the right in these FIGURES) initially wraps about the roller 32, next about the roller 46, then either about the roller 52 or 54, and lastly, about the roller 26. (In this regard, the decurler of the present invention will function to decurl a web irrespective of the direction that the running web moves through the decurler so long as the relatively movable, relatively large diameter roller and the relative movable, relatively small diameter roller are positioned between the two relatively fixed, relatively larger diameter rollers).

As illustrated in FIG. 3, the running web 12 in the decurler 114 wraps around the two fixed position rollers 26 and 32 and the two variable position rollers 46 and 52 as it follows the web path through the decurler 10. The roller 46 pivots about the central longitudinal axis of roller 32 and the distance between the rollers 32 and 4 is and remains fixed. The roller assembly 48 pivots around the fixed longitudinal central axis of the roll pin 68. The distance between the rollers 52 and 54 from the central longitudinal axis of the roll pin 68 is also fixed. In FIG. 4, the roller assembly 48 has been rotated or pivoted about the axis of the roll pin 68 (and through the imaginary plane including the axis 68 and the center of the roller 46) so that the web 12 is wrapped about the roller 54.

FIGS. 3 and 4 also include reference letters (capital, small, and greek) and "X" and "Y" coordinate axes relating to the method, discussed below, used to determine a profile of the cam surfaces 76 for a decurler of given dimensions.

In FIGS. 3 and 4 and in connection with the method discussed below: "A" identifies the center of the roller 32; "B" the center of roller 46; "D" the center of roller 26; "$C_1$" the center of roller 52; "$C_2$" the center of roller 54; "C" the midpoint of the straight line extending between $C_1$ and $C_2$; and "E" the longitudinal central axis of the roll pin 68. (Note that A is located on the "Y" axis and E is on the "X" axis in FIGS. 3 and 4. The letters "ab" indicate the length the web 12 wrapped about the roller 32; "cd", the length the web 12 wrapped about the roller 46; "ef", the length the web 12 wrapped about either roller 52 or 54, as the case may be; and "gh", the length the web 12 wrapped about the roller 26. The angle "$\Theta$" is the angle between the "Y" axis and the straight line AB (that is, angle the arm members 36 are disposed with respect to the vertical); "$\delta$" is the angle between the vertical and the straight line BE (that is, the line between E, the axis of roll pin 68, and B, the center of roller 46); "$\lambda$" is the angle between the vertical and the straight line between E and the $C_1$, or $C_2$, as the case may be depending on whether the web 12 is wrapped about $C_1$ or $C_2$, respectively; "$\mu$" is the angle between the straight line BE and the straight line CE; and "$\omega$" is the angle between CE and $C_1E$ or $C_2E$ (as the case may be depending on whether the web 12 is wrapped about $C_1$, or $C_2$, respectively).

As noted, the length of the running web 12 in the decurler (that is, between the point "a", where the web 12 first contacts the outer peripheral surface of roller 32, to the point "h" where the web 12 last contacts the outer peripheral surface of the roller 26, in FIGS. 3 and 4) must remain constant as the angle of web wrap about the rollers is altered by the relative movement of the rollers 46 and either 52 or 54. The method used to achieve this constant web length requirement is the development of the cam profile surfaces 76 which, when rotated about the axis of the roll pin 68 (as a unit with the roller assembly 48) will support the cam followers 108 and 112 on the central longitudinal axis of the roller 46 such as to cause the angle $\Theta$, in FIGS. 3 and 4, to change by an amount so as to maintain the path length of the web through the decurler constant.

This method is described as follows: For optimum efficiency, it is desirable to establish the geometry of the decurler 114 such that the force exerted by the cam followers 108 and 112 is made as constant as possible throughout the length of the cam profile surfaces 76. One of the inputs required to achieve this is an empirically derived starting value for the angle $\Theta$. In determining this, one must work with the following givens:

(1) The location of the rollers 32, 46, and 26 (that is, the points A, B, and D, respectively) and the axes of the roll pin 68 (the point E);

(2) The length of the radii of all the rollers 32, 46, 52, 54, and 26 that is, the radii $r_A$, $r_B$, $r_{C1}$, $r_{C2}$, and $r_D$, respectively;

(3) The distance AB between the rollers 32 and 46;

(4) The distance $C_1C_2$ between the rollers 52 and 54;

(5) The length of CE (the perpendicular from the line interconnecting the center of $C_1C_2$ and the axis of the roll pin 68); and (6) A starting value of the angle $\Theta$.

Then a reference path length for a zero angle of wrap around either the rollers 52 and 54 is calculated. From this starting point, two sets of incremental adjustments to the angle $\lambda$ are made. One set uses the declining values of $\lambda$ and produces the cam coordinates for the counter clockwise rotation of the cam profile surfaces 76. This cam movement causes the angle of wrap around roller 52 to increase. The second set of incremental adjustments uses increasing values of $\lambda$ and produces the cam coordinates for clockwise rotation of the profile surfaces 76. This cam movement causes the angle of wrap around the roller 54 to increase. The size of the step change value of λ controls the number of points described along the cam profile surfaces 76 and determines the smoothness of the cam profile. The cam profile for the value of λ during the transfer of the web 12 between the rollers 52 and 54 is described by a circle, having its center at E, the axis of the roll pin 68, with a radius calculated from the value of λ at which the angle of wrap around roller 52 or 54 becomes 0°. It should also be noted that all angles are measured, in radians, from the 12 o'clock position in a clockwise direction and are denoted by the point on the web path which they describe.

A description of the cam profile surfaces 76 for counter-clockwise rotation of the rollers 52 and 54 is based on the following calculations:

| | | | |
|---|---|---|---|
| Coordinates: | $B_x$ | = | $A_x + AB * SIN(\Theta)$ |
| | $B_y$ | = | $A_y + AB * COS(\Theta)$ |
| | $C_{1x}$ | = | $E_x + \gamma(EC^2 + (C_1C_2/2)^2) * SIN(\lambda)$ |
| | $C_{1y}$ | = | $E_y + \gamma(EC^2 + (C_1C_2/2)^2) * COS(3\lambda)$ |
| Angles: | a | = | $3\pi/2$ |
| | b | = | $\Theta + ATAN(bc/(r_A + r_B))$ |
| | c | = | $b + \pi$ |
| | d | = | $\pi/2 + ASIN((r_B + r_{C1}/\gamma((C_{1x} - B_x)^2 + (C_{1y} - B_y)^2)) - ASIN((C_{1x} - B_x)/\gamma((C_{1x} - B_x)^2 + (C_{1y} - B_y)^2))$ |
| | e | = | $d + \pi$ |
| | f | = | $3\pi/2 + ASIN((r_D - r_{C1})/\gamma((D_x - C_{1x})^2 + (D_y - C_{1y})_2) - ASIN((D_x - C_{1x})/\gamma((D_x - C_{1x})^2 + (D_y - C_{1y})^2)$ |
| | g | = | f |
| | h | = | $\pi$ |
| Web path lengths: | ab | = | $r_A(a - b)$ |
| | bc | = | $\gamma(AB^2 - (r_A + r_B)^2)$ |
| | cd | = | $r_B(2\pi - c + d)$ |
| | de | = | $\gamma((B_x - C_{1x})^2 + (B_y - C_{1y})^2 - (r_B + r_{C1})^2)$ |
| | ef | = | $R_{C1}(e - f)$ |
| | fg | = | $\gamma((D_x - C_{1x})^2 + (D_y - C_{1y})^2 - (r_D - r_{C1})^2)$ |
| | gh | = | $r_D(g - h)$ |
| Angles: | ω | = | $ATAN((C_1C_2/2)/EC)$ |
| | δ | = | $ASIN((B_x - E_x)/\gamma((B_x - E_x)^2 + (B_y - E_y)^2))$ |
| | μ | = | $\delta - \lambda + \omega$ |

The cam coordinates (X,Y) are measured with E at the point (0,0) and EC forming the Y axis.

| | | |
|---|---|---|
| Cam coordinate X | = | $\gamma((B_x - E_x)^2 + (B_y - E_y)^2)SIN(\mu)$ |
| Cam coordinate Y | = | $\gamma((B_x - E_x)^2 + (B_y - E_y)^2)COS(\mu)$ |

A description of the cam profile surface for clockwise rotation of the rollers 52 and 54 is based on the following calculations:

| | | | |
|---|---|---|---|
| Coordinates: | $B_x$ | = | $A_x + AB * SIN(\Theta)$ |
| | $B_y$ | = | $A_y + AB * COS(\Theta)$ |
| | $C_{2x}$ | = | $E_x + \gamma(EC^2 + (C_1C_2/2)^2) * SIN(\lambda)$ |
| | $C_{2y}$ | = | $E_y + \gamma(EC^2 + (C_1C_2/2)^2) * COS(3\lambda)$ |
| Angles: | a | = | $3\pi/2$ |
| | b | = | $\Theta + ATAN(bc/(r_A + r_B))$ |
| | c | = | $b + \pi$ |
| | d | = | $\pi/2 + ASIN((r_B + r_{C2}/\gamma((C_{2x} - B_x)^2 + (C_{2y} - B_y)^2)) - ASIN((C_{2x} - B_x)/\gamma((C_{2x} - B_x)^2 + (C_{2y} - B_y)^2))$ |

-continued

| | | | |
|---|---|---|---|
| | e | = | d |
| | f | = | $\pi/2 + ASIN((r_D - r_{C2})/\gamma((D_x - C_{2x})^2 + (D_y - C_{2y})^2) - ASIN((D_x - C_{2x})/\gamma((D_x - C_{2x})^2 + (D_y - C_{2y})^2)$ |
| | g | = | $f - \pi$ |
| | h | = | $\pi$ |
| Web path length: | ab | = | $r_A(a - b)$ |
| | bc | = | $\gamma(AB^2 - (r_A + r_B)^2)$ |
| | cd | = | $r_B(2\pi - c + d)$ |
| | de | = | $\gamma((B_x - C_{2x})^2 + (B_y - C_{2y})^2 - (r_B - r_{C2})^2)$ |
| | ef | = | $R_{C2}(f - e)$ |
| | fg | = | $\gamma((D_x - C_{2x})^2 + (D_y - C_{2y})^2 - (r_D + r_{C2})^2)$ |
| | gh | = | $r_D(g - h)$ |
| Angles: | ω | = | $ATAN((C_1C_2/2)/EC)$ |
| | δ | = | $ASIN((B_x - E_x)/\gamma((B_x - E_x)^2 + (B_y - E_y)^2))$ |
| | μ | = | $\delta - \lambda + \omega$ |

The cam coordinates (X,Y) are measured with E at the point (0,0) and EC forming the Y axis.

| | | |
|---|---|---|
| Cam coordinate X | = | $\gamma((B_x - E_x)^2 + (B_y - E_y)^2)SIN(\mu)$ |
| Cam coordinate Y | = | $\gamma((B_x - E_x)^2 + (B_y - E_y)^2)COS(\mu)$ |

It should also be noted to obtain a correctly profiled cam surface 76 using the X, Y, coordinates calculated as described above, the cutter used to cut the cam profile 76 must have the same diameter as the cam followers 108 and 112.

After correctly calculated cam profile surfaces 76 have been prepared, the running web 12 may be threaded through the decurler. The operator may then position the rollers 52 and 54 depending on whether he wishes to remove a clockwise or counterclockwise degree of curl from the running web 12 and also depending on the degree of curl he wishes to remove from the web. He accomplishes this by actuating the control system 98 so as to operate the linear actuator 94, and thus position the rollers to remove the undesireable curl.

The decurler 10 also includes a conventional web splice detector 116 adjacent to the outer peripheral surface of one of the rollers, as for example the roller 46. This detector is mounted on the decurler by means of a bracket 118 and arm 122 supported on one of the upper spacer tubes. The splice detector 116 senses the presence of a splice in the running web 12 in a conventional manner. When a splice is detected, it causes the control system 98 to move the rollers 52 and 54 to a position where the running web 12 is not wrapped about either of these rollers. This is advantageous since the running web coming off a new roll initially does not need much of any decurling. The operator is thus required to reset the decurler so that it will remove the amount of curl appropriate for the new web roll.

The preferred embodiment of the present invention has now been described. This preferred embodiment constitutes the best mode contemplated by the inventors for carrying out their invention. Because their invention may be copied without copying the precise details of the preferred embodiment, the following claims particularly point out and distinctly claim the subject matter which the inventors regard as their invention and which they wish to protect:

We claim:

1. An improved web decurler for selectively removing different degrees of curl from a running web, while maintaining web registration, as the running web passes along a web path that is defined in and through the web decurler, with the running web coming to the web decurler from a first webprocessing operation that is located upstream of the web decurler and proceeding from the web decurler to a second web-processing operation that is located downstream from the web decurler and that requires, for proper operation, web registration to exist between the second web processing operation and the running web upstream of the web decurler, the improved web decurler comprising:

a first roller assembly having a first, relatively large diameter, rotatable roller that has a central longitudinal axis and an outer peripheral surface, that is disposed adjacent to a first part of the web path in the web decurler so that the running web may wrap about a portion of its peripheral surface as the running web passes through the first part of the web path, and whose central longitudinal axis is fixed, relative to the web decurler;

a second roller assembly having a second, relatively large diameter, rotatable roller that has a central longitudinal axis and an outer peripheral surface, that is disposed adjacent to a second part of the web path in the web decurler so that the running web may wrap about a portion of its peripheral surface as the running web passes through the second part of the web path, and whose central longitudinal axis is fixed relative to the web decurler;

a third roller assembly having a third, relatively large diameter, rotatable roller that has a central longitudinal axis and an outer peripheral surface, that is disposed adjacent to a third part of the running web path in the web decurler so that the running web may wrap about a portion of its peripheral surface as the running web passes through the third part of the web path, that is disposed between the first and second rollers along the web path, and having means for maintaining the central longitudinal axis of said third roller a fixed predetermined distance from the central longitudinal axis of one of the first and second roller and means for moving said third roller about the central longitudinal axis of said one roller;

a fourth roller assembly having a fourth, relatively small diameter, rotatable roller that has a central longitudinal axis and an outer peripheral surface, that is disposed adjacent to a fourth part of the web path so that the running web may pass about a portion of its peripheral surface as the running web passes through the fourth part of the web path, that is disposed between the third roller and the other of the first and second rollers along the web path, and whose central longitudinal axis is spaced from and movable about a preselected axis which, in turn, is spaced from the central longitudinal axes of the first, second and third rollers;

means for supporting the first, second, third and fourth roller assemblies so that the first, second, third and fourth rollers may rotate about their respective central longitudinal axes; and means for adjustably positioning the third roller and the fourth roller with respect to each other, to the web path, and to the first and second rollers which are structured and arranged so that the length of the web path of the running web in the web decurler remains constant regardless of the adjusted positions of the third roller and the fourth roller and so as to control the wrap of the running web about the outer peripheral surfaces of the first, second, third and fourth rollers and to thus control the degree of curl removed from the running web, whereby the running web, although processed as a web, will lie flat, when cut and delivered as free sheets, downstream of the second web processing operation.

2. The improved web decurler described in claim 1 wherein the first roller assembly is adjacent to the upstream end of the web path in the web decurler; wherein the second roller is adjacent to the downstream end of the web path in the web decurler; and wherein the longitudinal axes of the first, second, third and fourth rollers are substantially parallel.

3. The improved web decurler described in claim 1 wherein the first roller assembly is adjacent to the downstream end of the web path in the web decurler; wherein the second roller is adjacent to the upstream end of the web path in the web decurler; and wherein the longitudinal axis of the first, second, third and fourth rollers are substantially parallel.

4. The improved web decurler described in claim 1 wherein the adjustable positioning means includes: said means for moving the third roller includes means to move the third roller along a first arc about the central longitudinal axis of said one roller; and means for moving the fourth roller along a second arc about the preselected spaced axis.

5. The improved web decurler described in claim 4 wherein the adjustable positioning means moves the third roller along the first arc in response to the movement of the fourth roller along the second arc.

6. The improved web decurler described in claim 4 wherein the means for moving the third roller moves the third roller to a predetermined position along the first arc in response to movement of the fourth roller to a particular position along the second arc.

7. The improved web decurler described in claim 6 wherein the means for moving the fourth roller includes means for selectively positioning the fourth roller at preselected particular positions along the second arc whereby the positions of the third roller and the fourth roller, with respect to each other and with respect to the first and second rollers, are such that the length of the web path remains constant in the web decurler.

8. The improved web decurler described in claim 4 wherein a first member extends between the longitudinal axis of the fourth roller assembly and the preselected spaced axis and supports the fourth roller for movement along the second arc; and wherein a second member extends between the third roller assembly and said one roller and supports the third roller for movement along the first arc.

9. The improved web decurler described in claim 8 wherein one of the first and second members includes a cam surface; and wherein the other of the first and second members includes a cam follower that is adapted to follow the cam surface so that movement of the first member, and the fourth roller assembly, along the second arc causes a predetermined movement of the third roller along the first arc.

10. The improved web decurler described in claim 9 wherein the cam surface is on the first member; and wherein the cam follower is on the second member.

11. The improved web decurler described in claim 10 includes means for selectively moving the first member about the preselected spaced axis so that the fourth roller moves along the second arc.

12. The improved web decurler described in claim 8 wherein a first plane is defined to include the longitudinal central axes of the third roller and the other roller; and wherein the preselected spaced axis is located, with respect to the first plane, such that the fourth roller assembly may be located on one side of the first plane when it is desired to decurl a counter-clockwise curl from the running web and on the other side of the first plane when it is desired to decurl a clockwise curl from the running web.

13. The improved web decurler described in claim 12 wherein the fourth roller assembly includes a pair of fourth rollers, with each of the fourth rollers having a central longitudinal axis and an outer peripheral surface; wherein one of the pair of fourth rollers is adapted to have the running web wrap about its outer peripheral surface when the fourth roller assembly is located on one side of the first plane; and wherein the other of the pair of fourth rollers is adapted to have the running web wrap about its outer peripheral surface when the fourth roller assembly is located on the other side of the first plane.

14. The improved web decurler described in claim 13 wherein said one roller is the second roller; and wherein the other roller is the first roller.

15. The improved web decurler described in claim 1 wherein a first plane is defined to include the longitudinal central axes of the third roller and the other roller; and wherein the preselected spaced axis is located, with respect to the first plane, such that the fourth roller assembly may be located on one side of the first plane when it is desired to decurl a counter-clockwise curl from the running web and on the other side of the first plane when it is desired to decurl a clockwise curl from the running web.

16. The improved web decurler described in claim 15 wherein the fourth roller assembly includes a pair of fourth rollers, with each of the fourth rollers having a central longitudinal axis and an outer peripheral surface; wherein one of the pair of fourth rollers is adapted to have the running web wrap about its outer peripheral surface when the fourth roller assembly is located on one side of the first plane; and wherein the other of the pair of fourth rollers is adapted to have the running web wrap about its outer peripheral surface when the fourth roller assembly is located on the other side of the first plane.

17. The improved web decurler described, in claim 1 wherein said one roller is the second roller; and wherein the other roller is the first roller.

18. The improved web decurler described in claim 1 wherein the first, second and third rollers all have the same diameters.

* * * * *